US006397742B1

(12) United States Patent
Proctor et al.

(10) Patent No.: US 6,397,742 B1
(45) Date of Patent: Jun. 4, 2002

(54) SINGLE PLANE SCREEN PRINTER

(75) Inventors: Arthur E. Proctor, Bailey; Bryan D. Proctor, Sparta, both of MI (US)

(73) Assignee: BecMar Corporation, Bailey, MI (US)

( * ) Notice: Subject to any disclaimer, the term of this patent is extended or adjusted under 35 U.S.C. 154(b) by 0 days.

(21) Appl. No.: 09/669,545

(22) Filed: Sep. 26, 2000

Related U.S. Application Data

(60) Provisional application No. 60/156,949, filed on Sep. 30, 1999.

(51) Int. Cl.[7] ..... B05C 17/04
(52) U.S. Cl. ..... 101/124
(58) Field of Search ..... 101/114, 123, 101/124, 126, 129

(56) References Cited

U.S. PATENT DOCUMENTS

| | | | | | |
|---|---|---|---|---|---|
| 4,121,519 | A | * | 10/1978 | Porth | 101/124 |
| 4,376,412 | A | * | 3/1983 | Nagatami | 101/124 |
| 4,589,336 | A | * | 5/1986 | Klemm | 101/124 |
| 4,945,827 | A | * | 8/1990 | Audi et al. | 101/35 |
| 5,142,975 | A | * | 9/1992 | Podalsky | 101/40.1 |
| 5,471,924 | A | * | 12/1995 | Helling | 101/38.1 |
| 5,706,722 | A | * | 1/1998 | Kurten et al. | 101/129 |

* cited by examiner

*Primary Examiner*—Ren Yan
(74) *Attorney, Agent, or Firm*—Price, Heneveld, Cooper, DeWitt & Litton

(57) ABSTRACT

A stencil screen printing machine includes a screen retention frame horizontally reciprocable forwardly and rearwardly in one dimension for retaining and reciprocating a print stencil screen in a plane during a forward print stroke and a rearward return stroke. The stencil screen printing machine includes a rotational print cylinder beneath the frame that has a rotational axis transverse to the one dimension and that has a cylindrical peripheral surface for supporting print stock to be printed. Vertically movable lifting and lowering supports are operably associated with the print cylinder and are shiftable to place the cylinder peripheral surface and the print stock thereon upwardly at the stencil screen plane. A stencil squeegee is operably located above the plane and has a lower edge. Vertically movable lowering and lifting supports are operably associated with the squeegee and are shiftable downwardly to place the squeegee lower edge at the plane. The cylinder has a pair of ends with a plurality of circumferentially spaced chambers with respective flow orifices to the cylinder peripheral surface. A manifold control creates a negative retention pressure and also a positive discharge pressure on the print stock over portions of the peripheral surface. By this arrangement, the forwardly moving screen retention frame and the squeegee cause rotation of the cylinder and advancement of print stock on the cylinder, and the squeegee and cylinder enable stencil printing through a screen onto print stock at the plane.

7 Claims, 16 Drawing Sheets

SINGLE PLANE SCREEN PRINTER

CROSS-REFERENCE TO RELATED APPLICATIONS

The present application claims benefit under 35 USC §119(e) of provisional patent application Ser. No. 60/156,949, filed Sep. 30, 1999, entitled SINGLE PLANE SCREEN PRINTER, the entire contents of which are incorporated herein by reference.

BACKGROUND OF THE INVENTION

This invention relates to stencil screen printing machines.

Stencil screen printing machines have been known for decades, typically being of the sheet stock print type, or the web stock print type. The machine employs a reversible carriage which supports the stencil screen frame and screen, a rotational print cylinder having sheet grippers, and a squeegee for moving ink through the screen onto a substrate sheet or web fed over the cylinder. The common way of feeding sheet stock is to grip the front edge via grippers positioned in an axial trough of the cylinder. The squeegee is lowered to push the screen down to the stock on the print cylinder. The cylinder and stencil screen carriage are operably connected to the drive mechanism to thereby be driven in synchronism. The cylinder rotates and the screen is linearly advanced with the sheet stock, pulling the sheet that is between the cylinder and the screen. After each sheet is printed, it is stripped from the cylinder by stripper elements, the squeegee is elevated from the cylinder and the screen, the cylinder rotates back to the starting position, and the screen frame and screen are reversed to the starting position to accommodate the next piece of stock.

Keeping the carriage drive, print cylinder, and stripper elements in synchronism during the drive condition is essential, but can be troublesome and requires complex mechanism in the press. Also, although the known presses are capable of printing sheet stock of different lengths and are capable of printing print patterns of different lengths, the screen frame carriage must shift the entire length of the maximum length sheet capable of being printed, since the linearly driven carriage must stay in synchronism with the rotationally driven print cylinder. This results in lost time and extra equipment wear when printing shorter stock and/or shorter print patterns.

Another troublesome factor with screen printing equipment is the distortion of the print pattern which can occur as a result of the squeegee necessarily pressing and bowing the stencil screen down to the underlying print cylinder. This lowers the print quality and can also cause excess scrap product, especially when the specifications of the printed product are highly exacting.

SUMMARY OF THE INVENTION

The novel stencil screen printing press herein simplifies the printing operation and the equipment. The screen frame carriage is driven independently of the rotational print cylinder. The carriage drive is controllable to reciprocate a variety of selected distance amounts, thereby readily accommodating different length stock and/or print patterns, without concern for keeping the carriage drive in synchronism with the print cylinder drive. A servo motor drives the carriage forwardly and rearwardly the selected amount to suit the length of the stock and print pattern. The cylinder is not positively driven, but rather is free wheeling in nature. It has no sheet grippers. The sheet stock is advanced and the cylinder is rotated in synchronism with the sheet stock by the advancing screen as gripped by the squeegee against the sheet stock and cylinder.

The novel apparatus does not distort the stencil screen by the lowered engaging squeegee. The cylinder surface and the squeegee are both in the same plane as the infeeding stencil screen and print stock. The cylinder is elevated to this screen plane when the squeegee is lowered to this screen plane. Hence, the screen is not bowed (i.e., distorted) by the squeegee. Therefore, the print pattern is not distorted, and this results in higher quality product and less potential scrap. This feature could also be used for printing web stock.

The print cylinder employs vacuum at its peripheral portion engaging the sheet stock leading edge, to pull the stock and infeed it as the cylinder rotates. The cylinder, however, has positive pressure (i.e., blowing at its peripheral portion engaging the part of the sheet stock already printed) to separate the printed stock from the cylinder surface.

These and other features, objects, and advantages of the invention will become apparent from studying the following specification in conjunction with the drawings.

BRIEF DESCRIPTION OF THE DRAWINGS

FIGS. 1' through 12' correspond to FIGS. 1–12 noted above, with added explanatory wording on the face of the drawings.

DESCRIPTION OF THE PREFERRED EMBODIMENT

Figure 1:
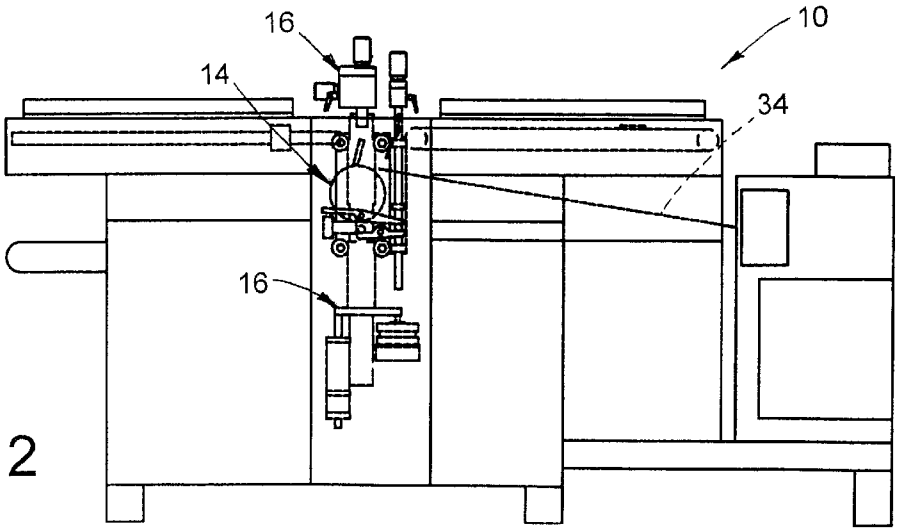
FIG. 1 is a side elevational view of the screen printing press according to this invention.
Figure 2:
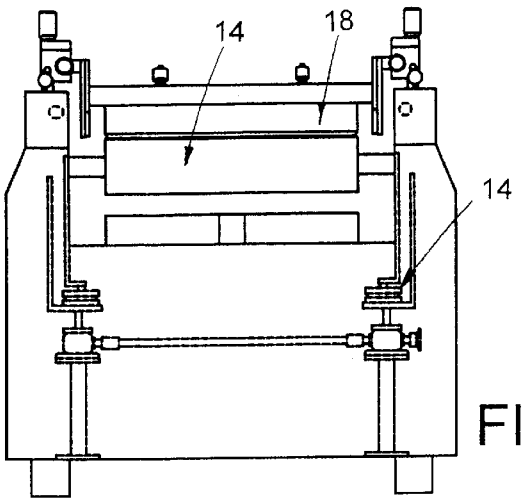
FIG. 2 is an end elevational view taken from the left end of FIG. 1.
Figure 3:
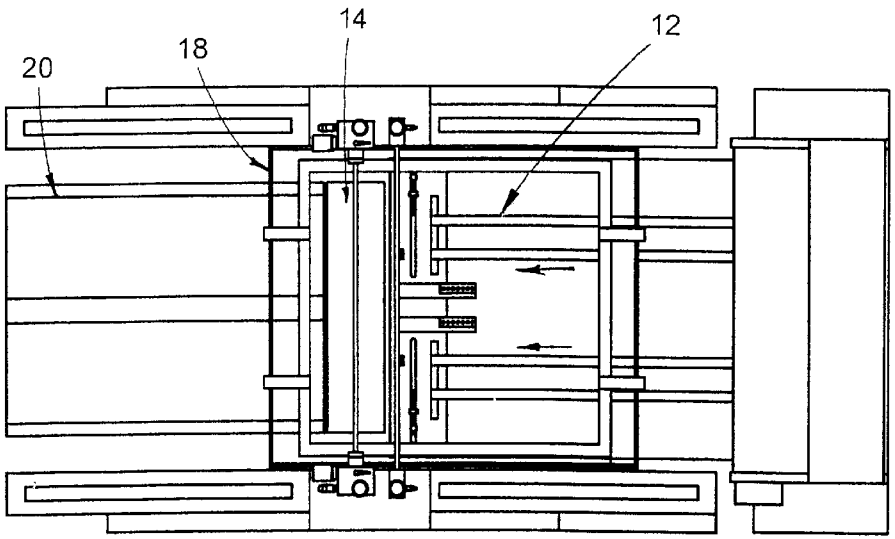
FIG. 3 is a top plan view of the press in FIGS. 1 and 2.
Figure 4:
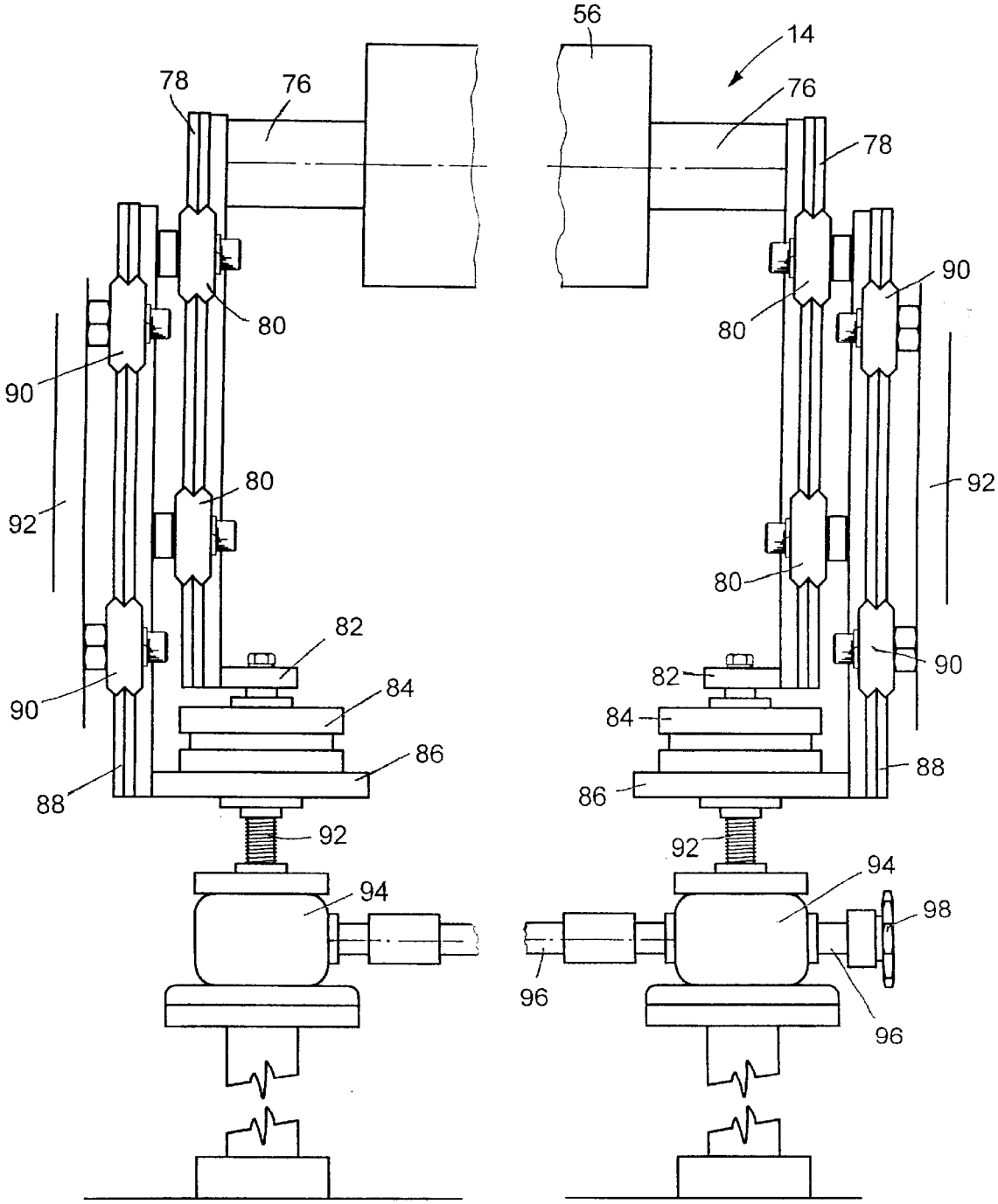
FIG. 4 is an enlarged, fragmentary, end elevational view of the print cylinder and its support and lift mechanism.
Figure 5:
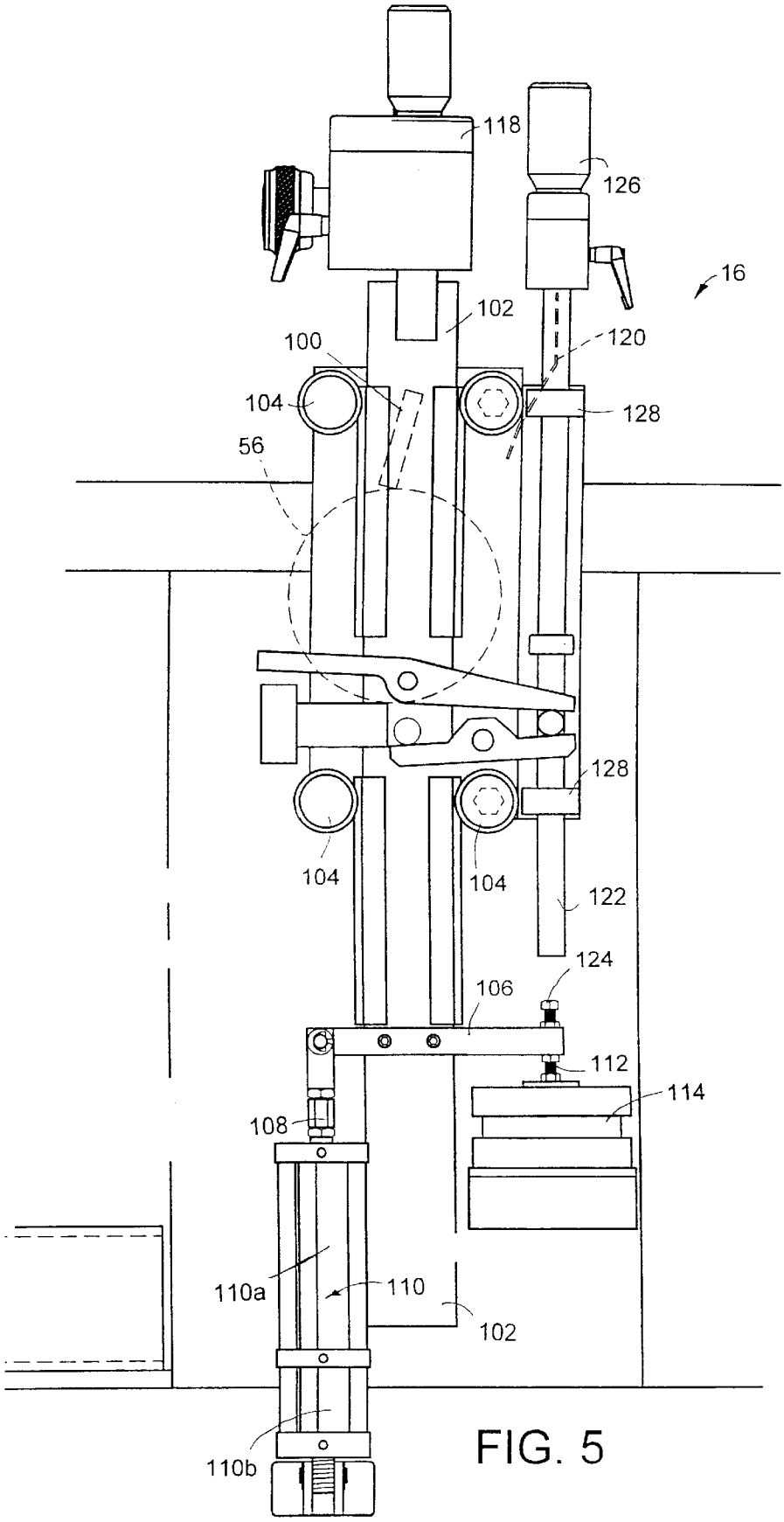
FIG. 5 is a fragmentary, side elevational view of the squeegee and its support and lift mechanism.
Figure 10:
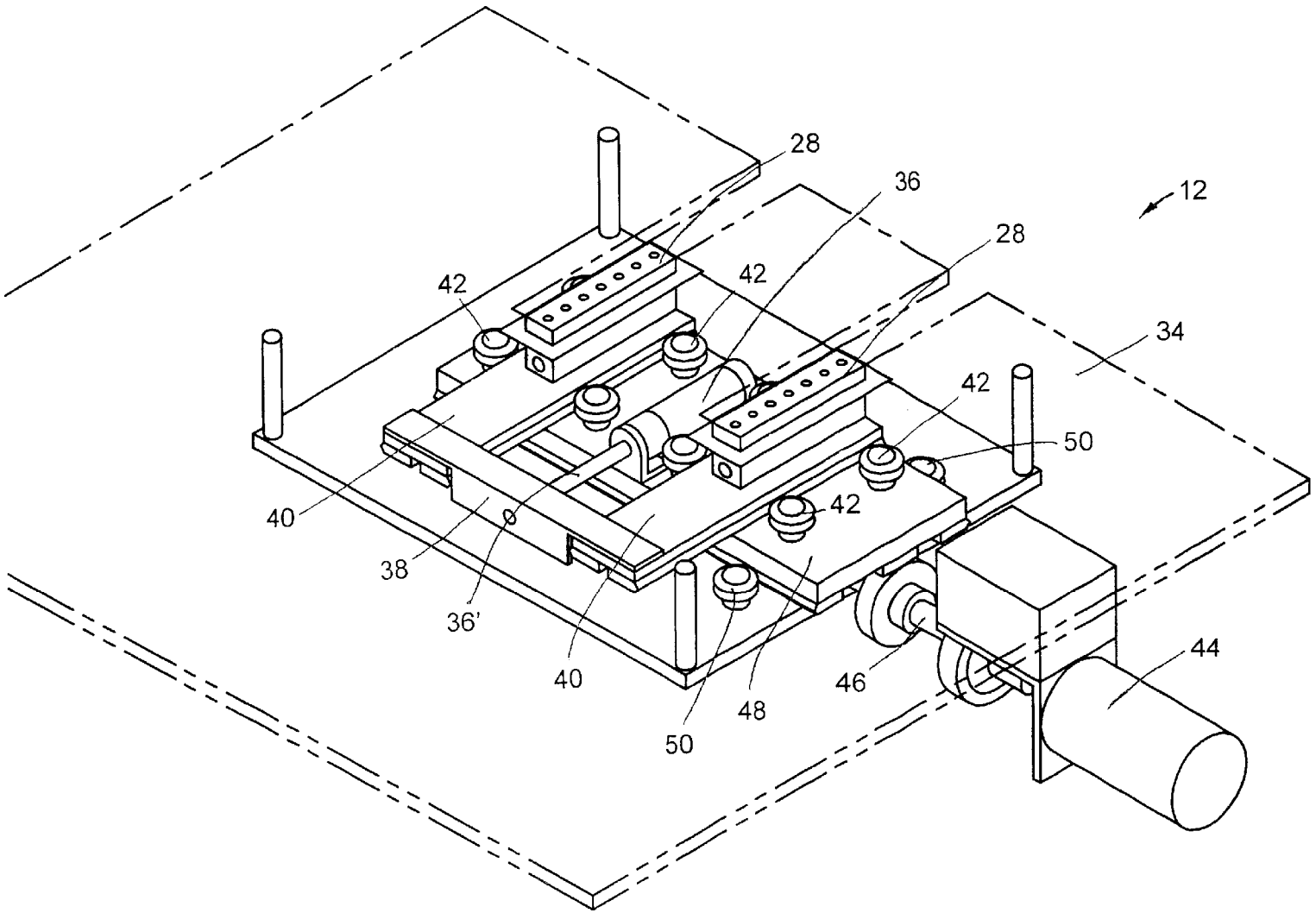
FIG. 10 is a fragmentary, isometric view of the print stock infeed and registration apparatus.
Figure 11:
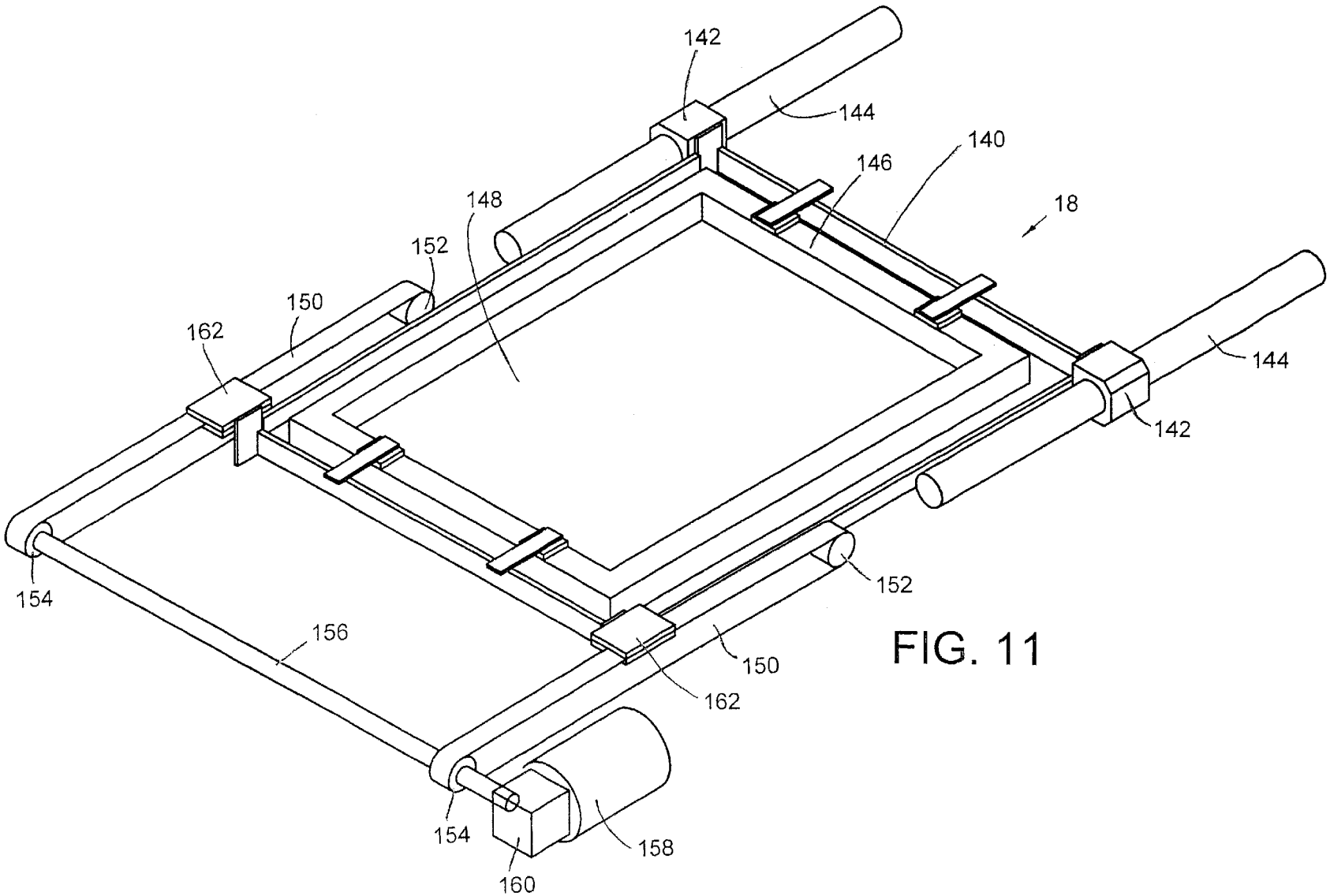
FIG. 11 is an isometric view of the stencil screen frame carriage and drive apparatus.

Referring first to FIGS. 1–3, the stencil screen printing press assembly 10 includes sheet infeed and alignment subassembly 12, print cylinder subassembly 14, squeegee subassembly 16, stencil screen carriage subassembly 18, and sheet discharge subassembly 20. The infeed subassembly 12 is shown more specifically in FIGS. 9 and 10. The cylinder subassembly 14 is shown more specifically in FIGS. 4 and 6–8. The squeegee subassembly 16 is shown more specifically in FIG. 5. The stencil screen frame carriage subassembly 18 is shown more specifically in FIG. 11.

Figure 9:
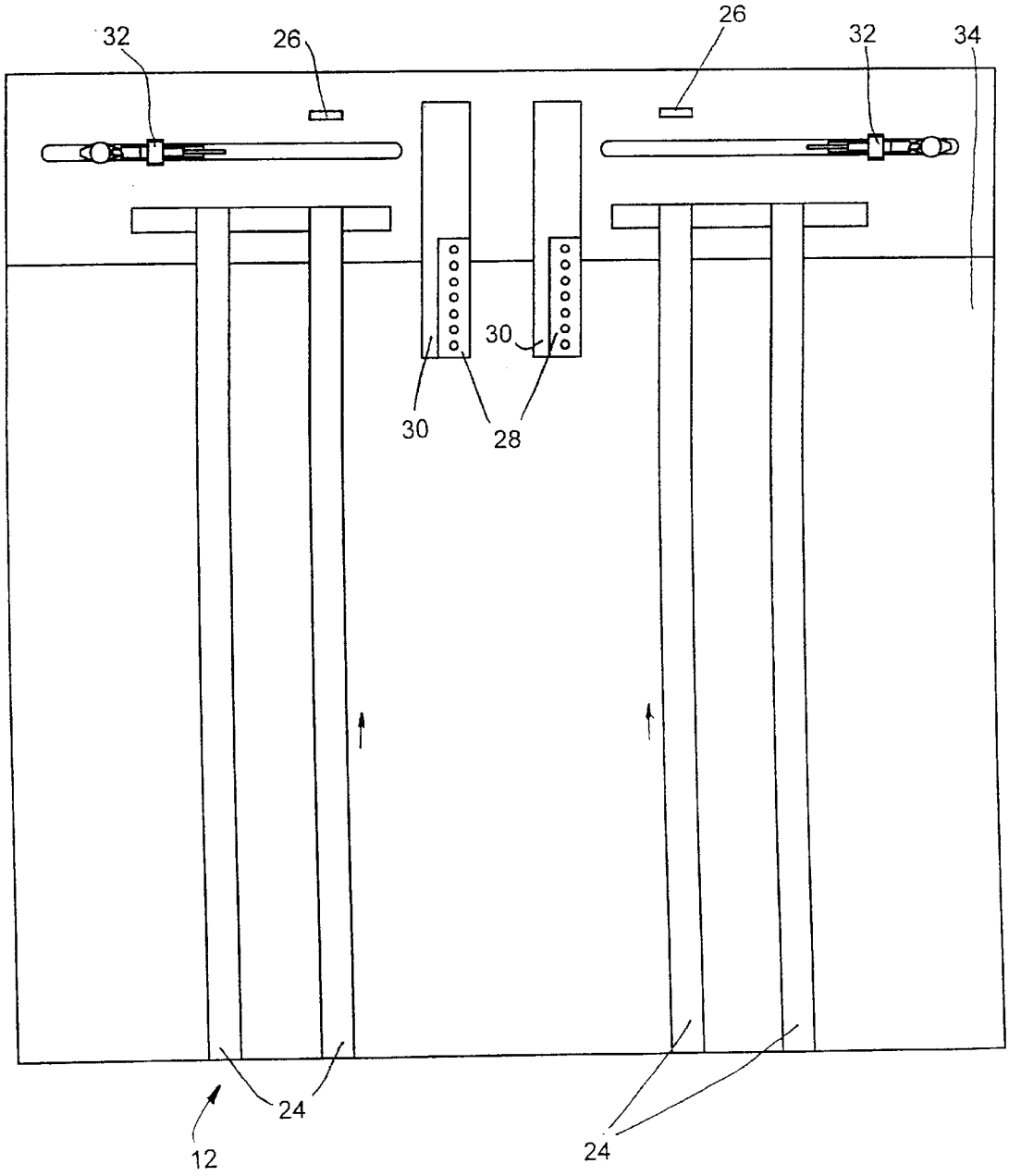
FIG. 9 is a plan view of the sheet stock infeed and registry mechanism.

Referring to the infeed subassembly 12, and particularly FIG. 9, sheet stock (i.e., substrate) is advanced up a slanted feedboard 34 from a supply of sheet stock in a conventional fashion by a plurality of generally parallel endless feedboard belts or ribbons 24 toward a pair of vertically movable temporary stops 26 upstream of and near the print cylinder subassembly. These stops are powered up and down to be capable of rising up into the path of an infeed sheet so the sheet abuts the two stops momentarily to be aligned. A pair of elongated vacuum bars (i.e., platens 28) beneath the sheet have a plurality of orifices through which vacuum (i.e., pressure differential) can be applied to the sheet. The vacuum platens 28 are substantially flush with the feedboard 34 and are operably connected with a suitable vacuum source such as a pump (not shown) in conventional manner. Platens 28 can be moved longitudinally relative to the press assembly by a fluid cylinder actuator 36 which has its piston rod 36' connected to a crossmember 38 attached to a pair of slides 40 movable within guide wheels 42. Lateral movement of platens 28 is achieved by a servo motor 44 which actuates a lead screw 46 within a nut to cause slide plate 48 to move laterally as retained by guide wheels 50. The vacuum platens are laterally shiftable a small controlled amount within elongated cavities 30, to laterally align the sheets to a predetermined location determined by photoelectric eye sensors 32 which are laterally adjustable to a controlled location. Once the sheet is registered in the longitudinal direction by the temporary stops, platens 28 advance the sheet stock or substrate to a position causing the leading portion of the sheet stock to overlap the transversely oriented, freely rotatable print cylinder 56 of the print cylinder subassembly 14. Then the sheet is shifted in the lateral direction by the laterally moving vacuum platens 28 to laterally align the sheet.

The print cylinder subassembly 14 includes freely rotatable print cylinder 56 rotatable on its transverse axis. It is constructed to have several separated, elongated chambers 58 within the cylinder around the periphery. Each chamber communicates with the cylinder outer peripheral surface by sets of orifices 60, each set extending longitudinally of the cylinder. At the ends of the cylinder are annular bearings 62, around one of which an outer vacuum ring 64 is placed. Ring 64 has a plurality of axially oriented passages 64' in communication with chamber 58. Within ring 64 is a pair of brackets, namely inner vacuum bracket 66 and inner pressure bracket 68. These brackets each have a passage 66' and 68', and are rotationally adjustable for the purpose of adjusting the exact rotational position of the rotating cylinder where vacuum (i.e., negative pressure or positive pressure) is applied to each of the respective segmental chambers 58.

Cylinder 56 is completely cylindrical in its outer surface (i.e., having no conventional transverse ditch at a portion thereof and having no sheet grippers) which would conventionally be mounted in such a ditch. It is free wheeling in nature, being caused to rotate only as a result of the stencil screen and sheet stock being pressed against the print cylinder surface by a squeegee.

One significant aspect of this apparatus is the characteristic of print cylinder 56 being caused to move up vertically into the plane of the feed stock and stencil screen while the lower edge of the squeegee is moved down into this plane so that there is single plane contact, without depressed distortion of the stencil screen during the printing operation as is conventional. The controlled vertical upward movement of cylinder 56 is achieved by the apparatus depicted in FIG. 4. Specifically, the ends of cylinder 56 are mounted on bearing supports 76, the opposite ends of which are attached to the upper ends of a pair of vertically oriented vee tracks 78 engaging two pairs of upper and lower guide wheels 80 for each track 78. The lower ends of vee track 78 have lateral brackets 82, which are mounted to the upper ends of a pair of fluid actuator cylinders 84. The lower ends of these fluid cylinders are mounted to brackets 86. Brackets 86 are laterally stabilized by being attached to the lower ends of another pair of vertical vee tracks 88 to which guide rollers 80 are mounted. Additional sets of guide rollers 90 are attached to the side frame elements 92 of the press for guiding vee tracks 88. Brackets 86 are supported on the upper ends of a pair of screw shafts 92 which can be rotated via gear boxes 94 by shaft 96 having a manual turn handle 98 on one end thereof. This screw shaft arrangement allows minor vertical adjustment of the final position of cylinder 56 in its raised condition, so as to accommodate differing stock (substrate) thicknesses being printed. Fluid cylinders 84 typically will raise the cylinder about one-quarter inch or so, so that its upper surface is in the plane of the stencil screen mounted on the bottom of the stencil screen frame (FIG. 12) and advanced and reversed by the stencil screen frame and carriage subassembly 18. This subassembly is driven completely independently of cylinder 56, in contrast to prior equipment wherein the cylinder was power driven in exact synchronism with the carriage, the cylinder reversing with the carriage reversal. The present cylinder 56 does not reverse, but simply remains stationary during reversal of the stencil screen frame carriage. In FIG. 3, the stencil screen frame is shown without a stencil screen so that the underlying structure can be seen.

The squeegee subassembly 16 (FIG. 5) is vertically shiftable in synchronism with the cylinder vertical movement and the carriage movement. Thus, squeegee blade 100 is vertically shifted between three positions, a high lift position, a lowered position not yet in contact with the stencil screen during the first fraction of an inch of the screen frame travel, and a lowermost print position with the lower edge of the blade engaging the stencil screen, to force ink through the stencil screen onto the substrate (i.e., sheet stock). The transversely elongated squeegee blade 100 of conventional type is mounted at its ends to a pair of like, mirror image, vertical squeegee lift plates 102 which are vertically movable within guide rollers 104 of which there are two pairs for each plate 102. One of the plates 102 is attached to a bracket 106, one end of which is connected through piston rod 108 of actuator fluid cylinder 110. This cylinder 110 is a two stage fluid (preferably air) cylinder, the upper stage **110*a* being the high lift stage and the other lower stage 110*b* being the print stage. The opposite end of horizontal bracket 106 serves to engage a stop 112 on the upper end of a second fluid (air) cylinder 114 affixed to the frame of the press and serving as a stop cylinder. Thus, when actuator cylinder stage 110*a* lowers bracket 106 and hence plates 102 as well as the entire squeegee subassembly, bracket 106 will engage stop 112 to temporarily halt the position of squeegee blade 100 short of engaging the stencil screen. Subsequently, fluid cylinder stage 110*b* retracts along with cylinder 114 to allow the squeegee subassembly to lower a further small amount for engagement of the stencil screen 170, and printing. At the upper ends of plate 102 is a squeegee manual adjustment head 118** of conventional type to adjust the exact final lowered position of the squeegee blade.

Cooperative with the squeegee subassembly is a conventional flow coater or flood blade 120. A flood blade serves to distribute the puddle of ink at the tail end of the stencil screen, following a print stroke, back across the screen frame in a thin layer of ink on top of the screen so the next print strike by the squeegee will have appropriate ink to force through the stencil screen. In this apparatus, a flood blade lift shaft 122 is vertically arranged so that upon bracket 106 being raised by fluid cylinder 110, the upper adjustable bolt 124 on bracket 106 will engage the bottom end of shaft 122 to raise the flood blade 120 in a manner to be described hereinafter. A conventional flood blade adjustment head 126 is positioned at the upper end of the flood blade for minor adjustment thereof. Shaft 122 is guided within stationary bearings 128 at its upper and lower ends. These bearings are mounted to the press frame.

The stencil screen frame carriage subassembly 18 (FIG. 11) is operated to reciprocate forwardly and backwardly. The carriage 140 is mounted on slide bearings 142 which move along a longitudinally extending pair of guide rails 144, and support the removable stencil screen frame 146. The desired stencil screen with an appropriate print pattern is mounted within the space 148 of frame 146, at the lower surface of the frame, so as to be in the same plane as the upper surface of the print stock on cylinder 56 and the lower edge of the squeegee blade 100, during the print stroke. Carriage 140 is reciprocated forwardly and rearwardly by a pair of endless timing belts 150 on opposite sides of the frame, these being re-circulating belts which pass around idler wheels 152 and around power driven wheels 154. Wheels 154 are powered by rotational shaft 156 via a servo motor 158 through a gear box 160. Carriage 140 is secured to timing belts 150 by clamps 162. Thus, as servo motor 158 powers shaft 156 in one rotational direction and then in the opposite rotational direction, the carriage and stencil screen frame will be driven forwardly and rearwardly. Servo motor 158 is controlled in synchronism with fluid cylinders 110 and 114 which operate the squeegee, and with cylinder actuators 84 which vertically shift print cylinder 56.

Figure 6:
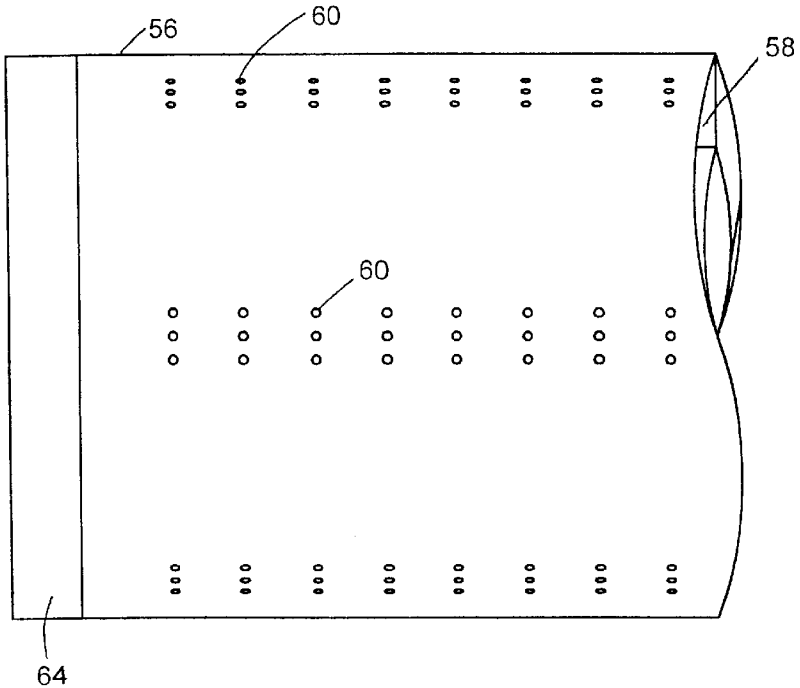
FIG. 6 is a fragmentary, elevational view of a portion of the print cylinder.
Figure 7:
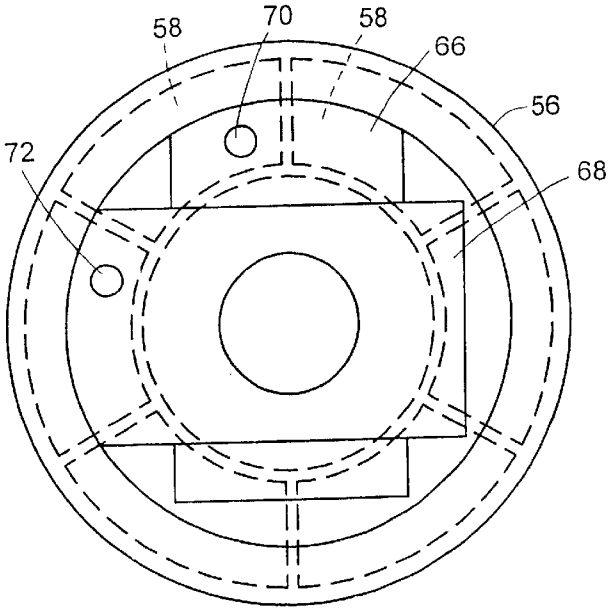
FIG. 7 is an end elevational view of the print cylinder.
Figure 8:
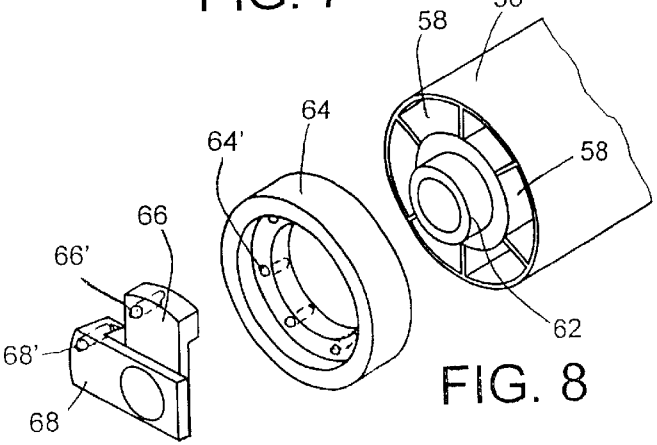
FIG. 8 is a fragmentary, exploded view of one end of the print cylinder.
Figure 12D:
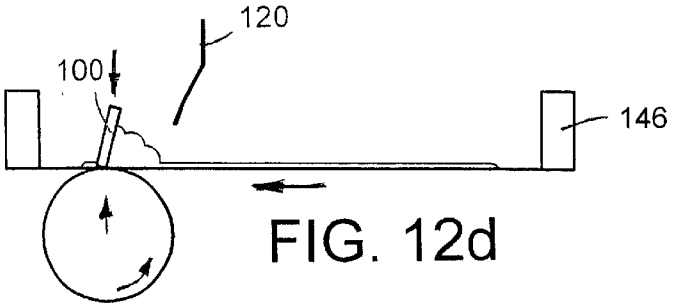
FIG. 12 is a schematic series of six side elevational views of the print cylinder, squeegee, flow coater, and stencil screen frame and screen showing six sequential steps in operation of the novel apparatus, with these six steps being identified as FIGS. 12*a*–12*f*.
Figure 12E:
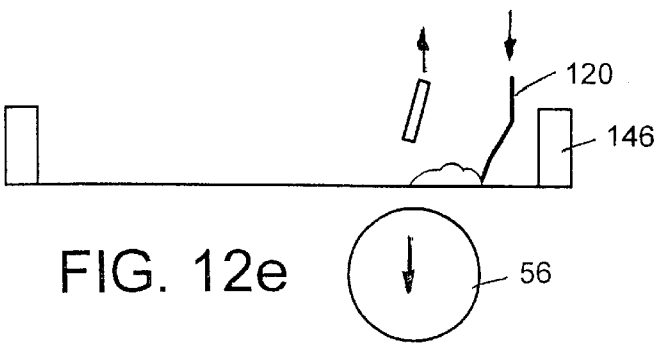
Figure 12F:
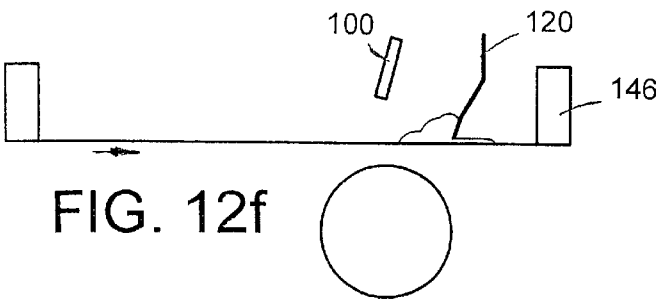
Figure 12A:
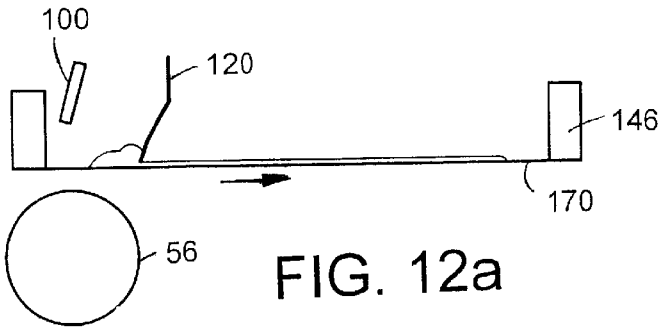
Figure 12B:
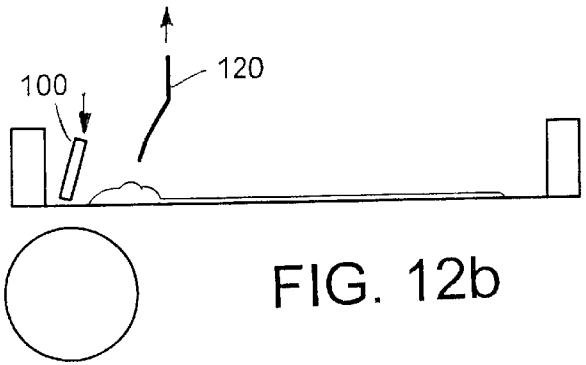
Figure 12C:
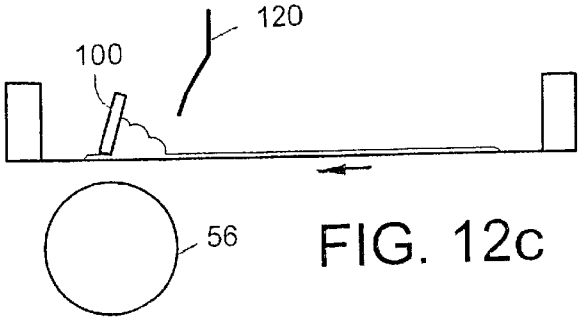
Figures 1, 2, 3:
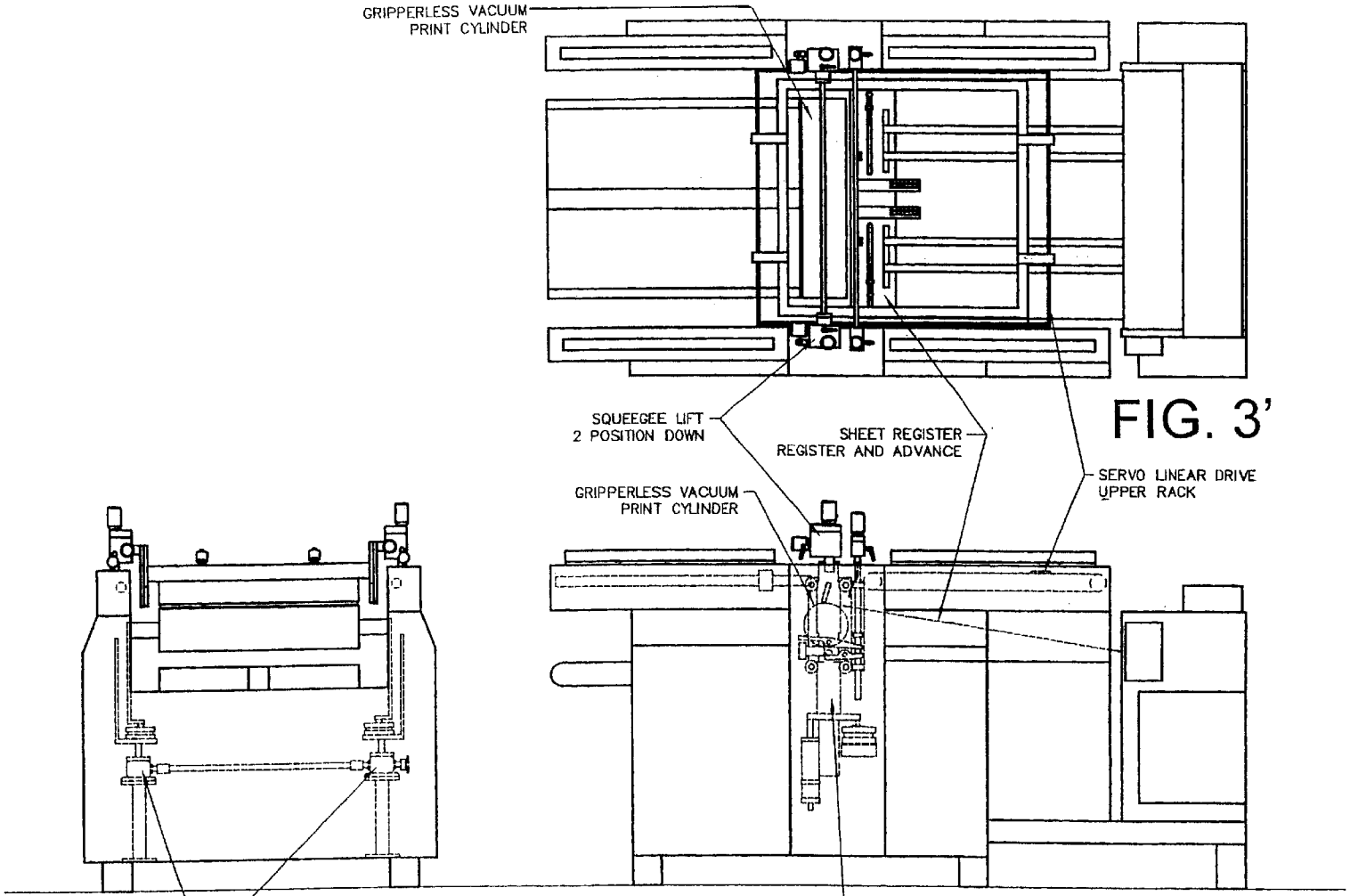
Figure 4:
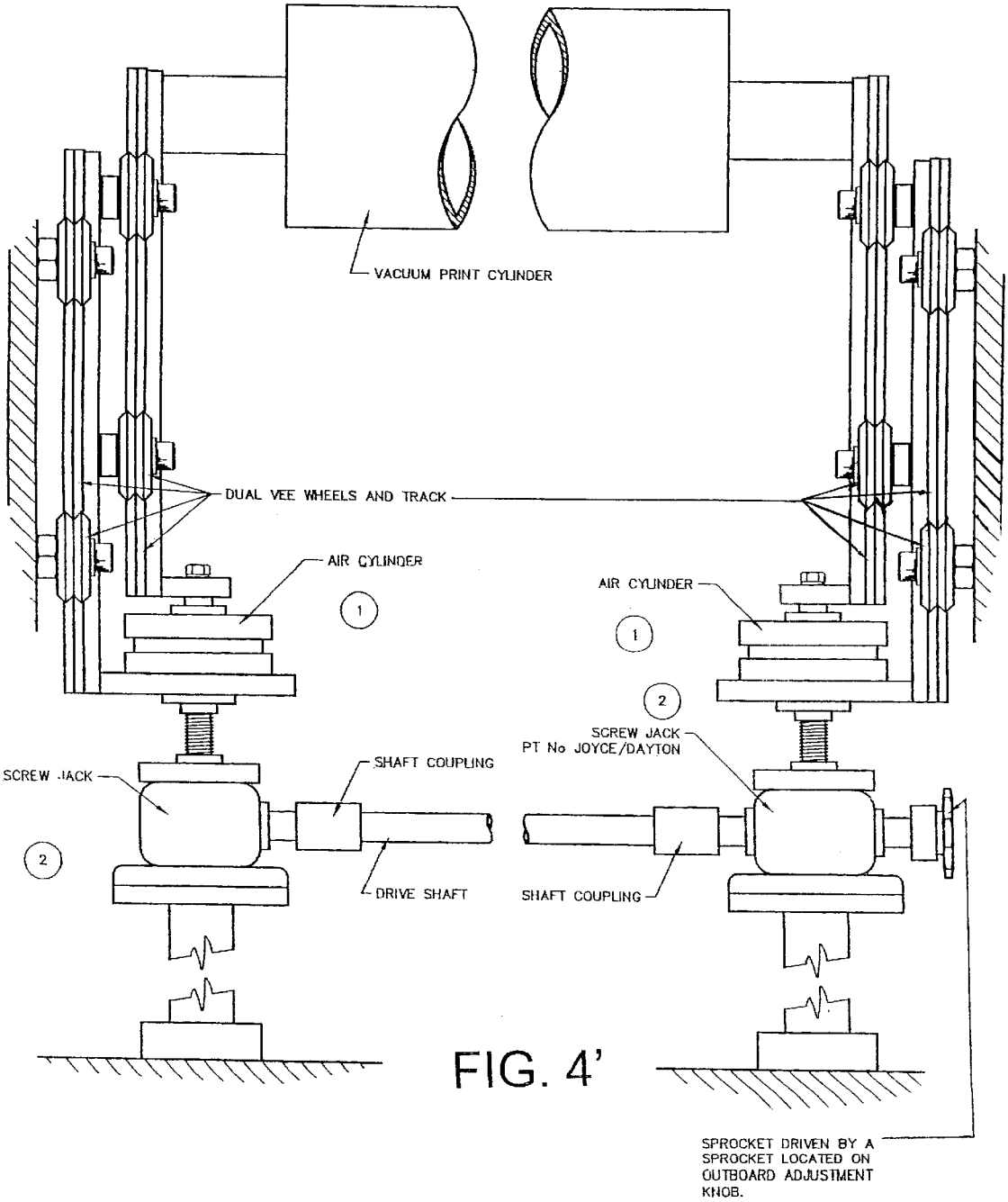
Figure 5:
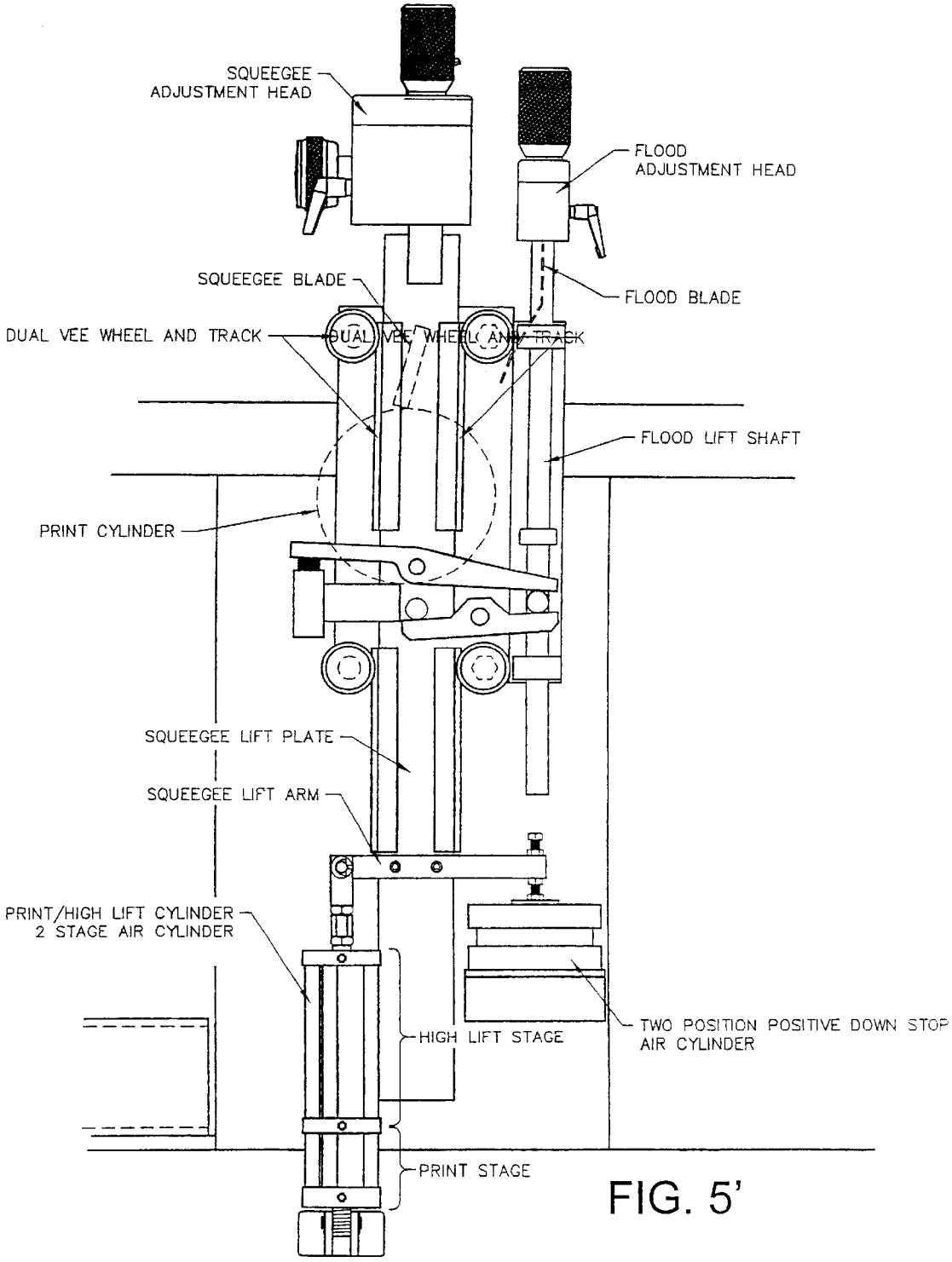
Figure 6:
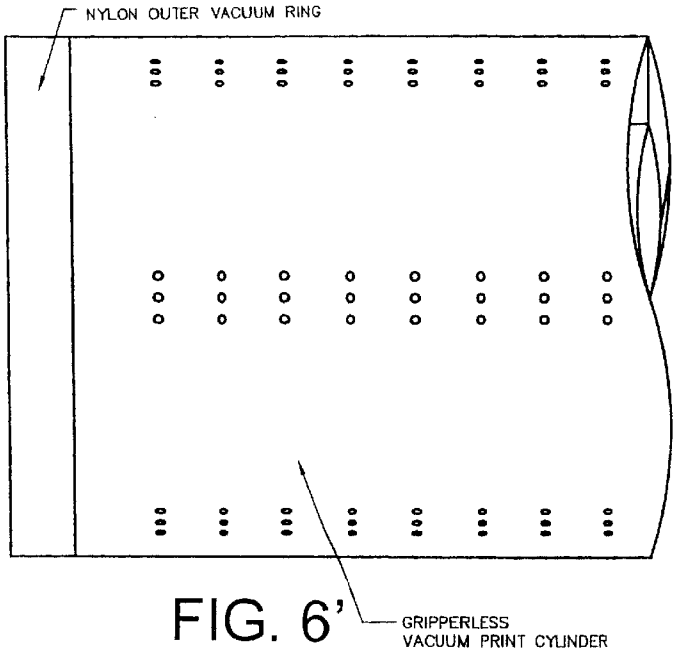
Figure 7:
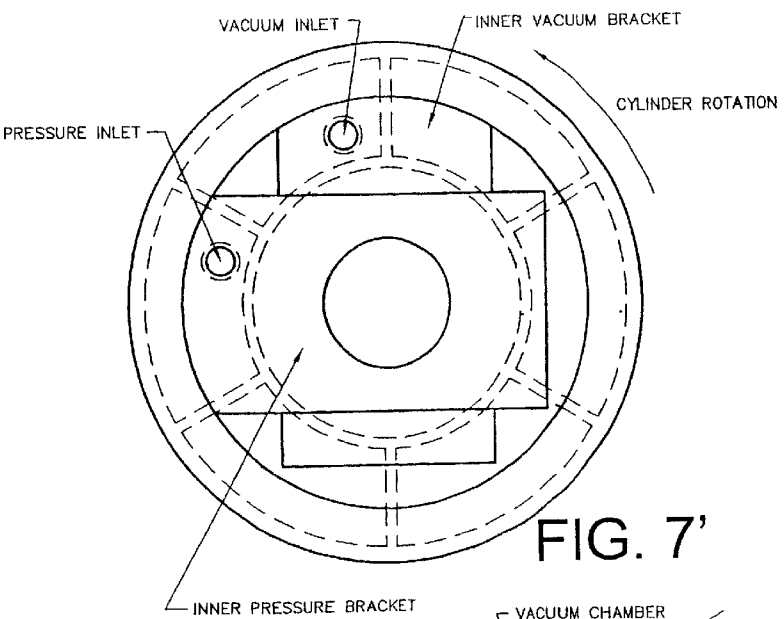
Figure 8:
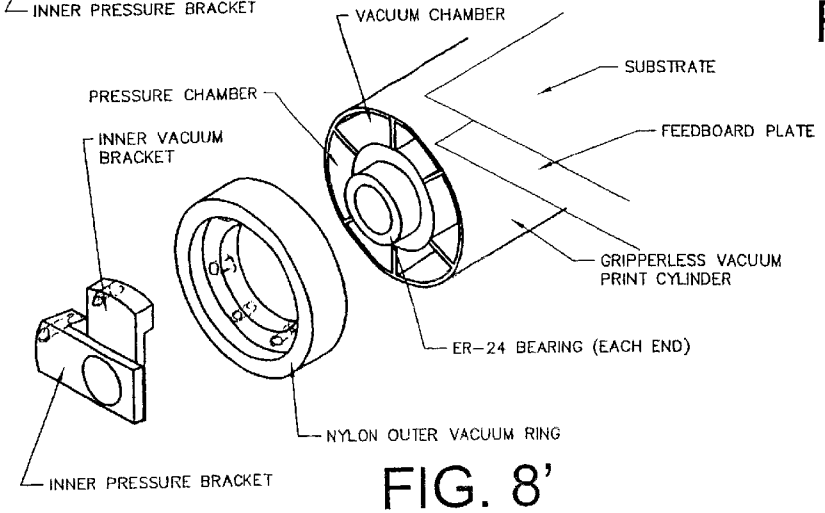
Figure 9:
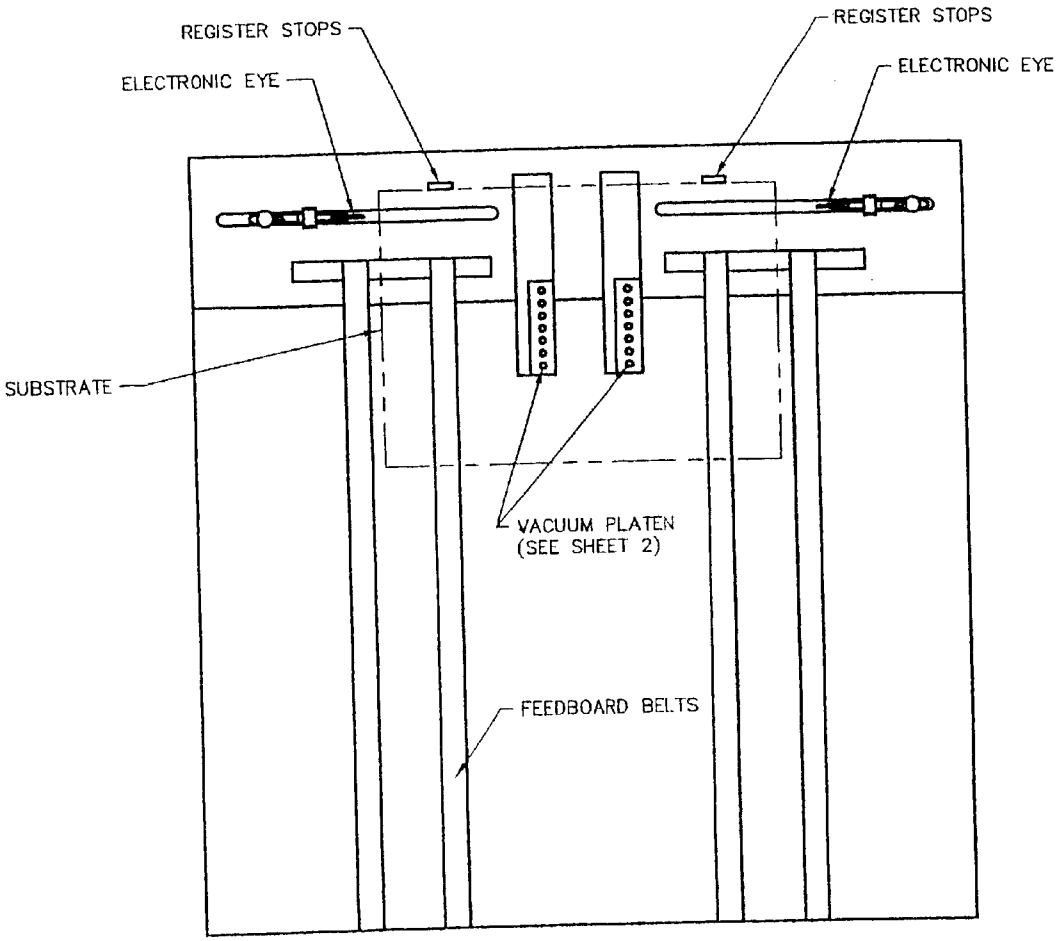
Figure 10:
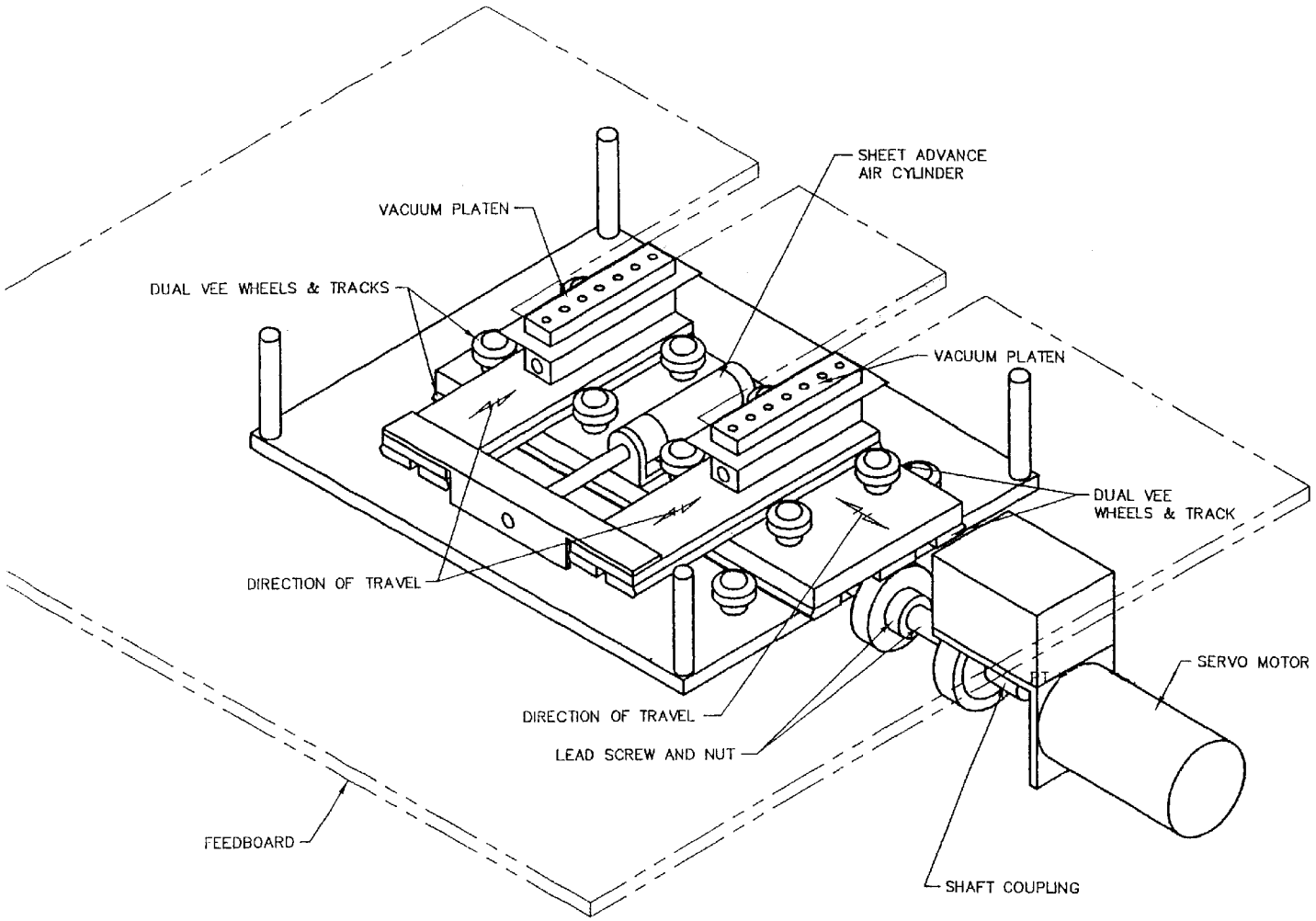
Figure 11:
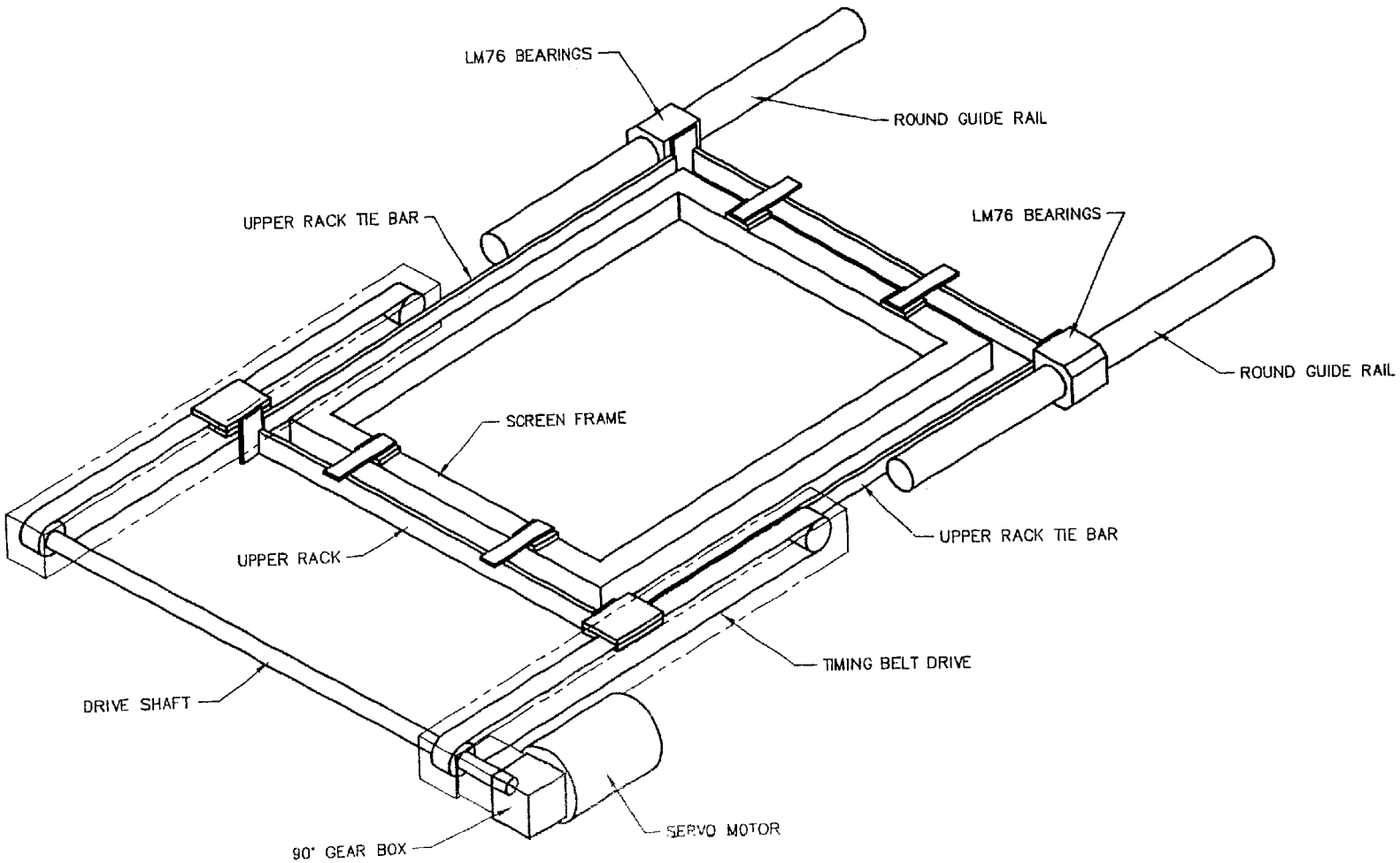
Figure 12:
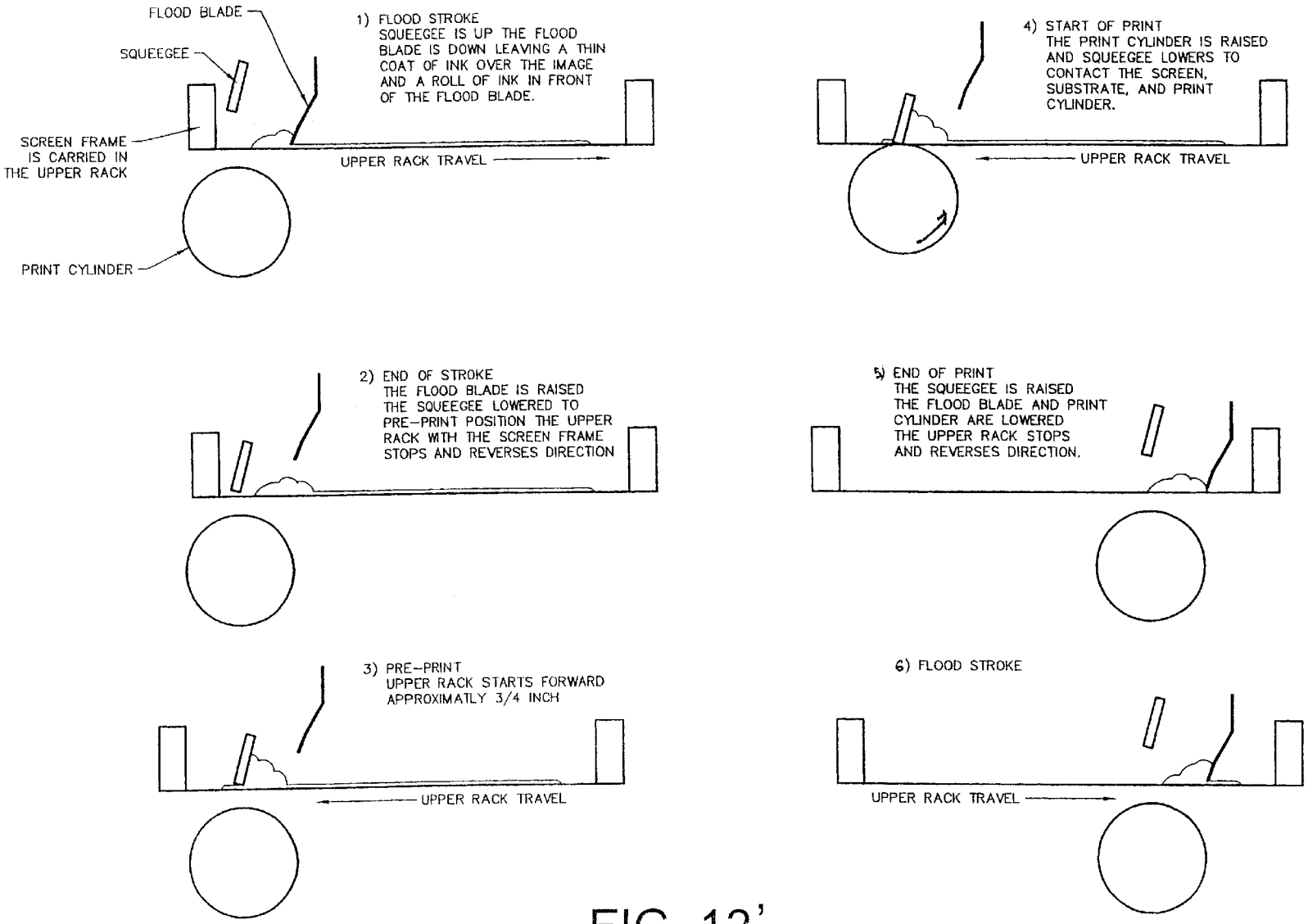

Referring now to the operational sequence shown in FIG. 12, namely FIGS. 12*a*–12*f*, in FIG. 12*a* the apparatus is shown first following a print stroke and about to reverse. The print cylinder is lowered and stationary, screen frame 146 and its screen 170 at the bottom thereof are moved in reverse for a flood stroke wherein the squeegee blade 100 is elevated and the flood blade 120 is lowered to a level a fraction of an inch above the screen 170, to leave a thin coat of ink over the screen print image and create a roll of ink in front of the flood blade. Referring to the next step in FIG. 12*b*, at the end of the reverse stroke the flood blade is elevated and squeegee 100 is lowered to a pre-print position still elevated above stencil screen 170 a fraction of an inch, at which time the screen frame 146 stops and reverses direction to move forwardly. The purpose of the pre-print/print position is to allow the even flood of the ink past the image area. The second drop of the squeegee happens at the start of the image. The cylinder 56 is in its lowered, non-operative position. The condition wherein the screen frame begins to move forwardly for the pre-print stroke for approximately three-fourths of an inch or so, the squeegee still being elevated slightly above the stencil screen and the flow coat blade being elevated to its inoperative position while the cylinder is still lowered in non-rotating condition (as shown in FIG. 12*c*). Referring to FIG. 12*d*, this shows the start of the print stroke wherein the squeegee blade 100 is lowered to the plane of the stencil screen and cylinder 56 is elevated to the plane of the sheet stock and stencil screen. Stencil frame 146 begins movement in the forward direction with the sheet substrate being squeezed between elevated cylinder 56, lowered squeegee blade 100, and screen 170. In this condition, the pressure of the squeegee blade against the screen and print stock onto the cylinder causes the cylinder to rotate along with advancement of the frame and print stock past the squeegee and cylinder, and ink flow through the stencil screen pattern onto the stock. During this print stroke initiation, the leading edge of the sheet is retained against and pulled by the cylinder by the pressure differential caused by vacuum in cylinder chambers 58 (FIG. 7) through orifices 60 (FIG. 6). As the leading edge of the sheet moves past the squeegee, pressure is applied in chambers 58 at the leading edge of and sequential portions of the sheet to cause it to separate from the cylinder and move to the discharge subassembly of the press.

The end of the print stroke is depicted in FIG. 12*e*. At this point squeegee blade 100 is raised, cylinder 56 is lowered, and flood blade 120 is lowered to a position just above the stencil screen. At this point the frame 146 has stopped and will move into reverse so that, as shown in FIG. 12*f*, flood blade 120 will create a new coat of ink on stencil screen 170. When the flood blade 120 reaches the final flood coat forward position depicted in FIG. 12*a*, the cycle is repeated.

FIGS. 1'–12' are similar to FIGS. 1–12, but include descriptive text on the drawings.

In the foregoing description, those skilled in the art will readily appreciate that modifications may be made to the invention without departing from the concept disclosed herein. Such modifications are to be considered as included in the following claims, unless these claims, by their language, expressly state otherwise.

The invention claimed is:

1. A stencil screen printing machine comprising:

a screen retention frame horizontally reciprocable forwardly and rearwardly in one dimension, for retaining and reciprocating a print stencil screen in a plane during a forward print stroke and a rearward return stroke;

a rotational print cylinder beneath said frame, having a first rotational axis transverse to said one dimension, and having a cylindrical peripheral surface for supporting print stock to be printed;

vertically movable lifting and lowering first supports operably associated with said print cylinder, shiftable to place said cylinder peripheral surface and print stock thereon upwardly at said stencil screen plane;

a stencil squeegee above said plane and having a lower edge;

vertically movable lowering and lifting second supports operably associated with said squeegee, shiftable downwardly to place said squeegee lower edge at said plane, whereby said forwardly moving screen retention frame and said squeegee cause rotation of said cylinder and advancement of print stock on said cylinder, and said squeegee and cylinder enable stencil printing through a screen onto print stock at said plane.

2. The stencil screen printing machine in claim 1, wherein said print cylinder is free wheeling.

3. The stencil screen printing machine in claim 2, wherein said frame has a drive mechanism for reciprocating said frame, and said print cylinder is free of a drive connection to said drive mechanism.

4. A stencil screen printing machine comprising:

a screen retention frame horizontally reciprocable forwardly and rearwardly in one dimension, for retaining and reciprocating a print stencil screen in a plane during a forward print stroke and a rearward return stroke;

a rotational print cylinder beneath said frame, having a rotational axis transverse to said one dimension, and having a cylindrical peripheral surface for supporting print stock to be printed;

a stencil squeegee above said plane and having a lower edge at said plane; and vertically movable lifting and lowering supports operably associated with said print cylinder, shiftable to place said cylinder peripheral surface and print stock thereon upwardly at said stencil screen plane.

5. The stencil screen printing machine in claim 4, wherein said print cylinder is free wheeling.

6. The stencil screen printing machine in claim 4, wherein said frame has a drive mechanism for reciprocating said frame, and said print cylinder is free of a drive connection to said drive mechanism, and is free wheeling.

7. A stencil screen printing machine comprising:

a screen retention frame horizontally reciprocable in one dimension, for retaining and reciprocating a print stencil screen in a plane during a forward print stroke and rearward return stroke;

a rotational print cylinder beneath said frame, having a rotational axis transverse to said one dimension, and having a peripheral surface for supporting print stock to be printed;

a stencil squeegee above said plane and having a lower edge;

vertically movable lowering and lifting supports operably associated with said squeegee, shiftable to place said squeegee lower edge at said plane, whereby said squeegee and cylinder enable stencil printing through a screen onto print stock at said plane;

said cylinder having a pair of ends and a plurality of circumferentially spaced chambers between said ends, said chambers having respective flow orifices to said cylinder peripheral surface;

a negative pressure connection for at least one of said chambers, and a positive pressure connection for at least one other of said chambers; and a manifold control located proximate at least one of said axial ends to create a negative retention pressure on print stock over a portion of said peripheral surface and a positive discharge pressure on print stock over another portion of said peripheral surface.

* * * * *